US009925679B2

(12) United States Patent
Slutsky et al.

(10) Patent No.: US 9,925,679 B2
(45) Date of Patent: Mar. 27, 2018

(54) DEVICES AND METHODS FOR ASSISTING WITH SLICING ITEMS

(71) Applicant: I+D+M Creative, LLC, Wilmington, DE (US)

(72) Inventors: Fran Z. Slutsky, Boston, MA (US); Robert Hutton, IV, Providence, RI (US); Ayako Takase, Providence, RI (US)

(73) Assignee: I+D+M Creative, LLC, Wilmington, DE (US)

( * ) Notice: Subject to any disclaimer, the term of this patent is extended or adjusted under 35 U.S.C. 154(b) by 0 days.

(21) Appl. No.: 14/714,813

(22) Filed: May 18, 2015

(65) Prior Publication Data

US 2016/0297088 A1 Oct. 13, 2016

Related U.S. Application Data

(60) Provisional application No. 62/000,310, filed on May 19, 2014.

(51) Int. Cl.
*B25B 11/00* (2006.01)
*B26B 29/06* (2006.01)

(52) U.S. Cl.
CPC ..... *B26B 29/063* (2013.01)

(58) Field of Classification Search
CPC ..... B25B 1/00; B25B 11/00; B25B 11/02
USPC ..... 269/1
See application file for complete search history.

(56) References Cited

U.S. PATENT DOCUMENTS 2,618,852 A * 11/1952 Clough ..... A21C 11/12 30/299
2,679,274 A * 5/1954 Criner ..... B26B 29/063 24/489
3,347,296 A * 10/1967 Rothman ..... B26D 3/30 269/87.2
4,198,888 A * 4/1980 Gatt ..... B26D 7/015 83/468.1
4,205,832 A * 6/1980 Kuzio ..... A01K 97/045 269/87.2
4,250,618 A * 2/1981 Custer ..... A21C 15/04 30/114
4,253,650 A * 3/1981 Kuzio ..... A01K 97/045 269/87.2
4,550,636 A * 11/1985 Josselson ..... B26B 29/063 269/295
4,815,169 A * 3/1989 Valleau ..... A22C 25/16 269/87.2

(Continued)

*Primary Examiner* — Lee D Wilson
(74) *Attorney, Agent, or Firm* — Pierce Atwood LLP

(57) ABSTRACT

Devices and methods for assisting with slicing items, such as food items, are disclosed. The devices may be referred to as press and slice devices. Such devices may include a base and a lid. The base and lid may each include a flexible layer, and flexible layers may be configured to hold the items being sliced when the lid and base are pressed together. The lid may include a handle to, for example help the user hold the lid and protect the user's fingers. The base may include a foot made of a material with a higher coefficient of friction than the material of the base to, for example help secure the base to the surface the device is being used on. The lid and base may include a mechanism for positionally securing the lid relative to the base, such as using a post and slot system.

14 Claims, 6 Drawing Sheets

(56) References Cited

U.S. PATENT DOCUMENTS 5,431,078 A * 7/1995 Ricard ..... B26B 29/063 83/454
5,664,474 A * 9/1997 Punt ..... A47J 47/005 269/290
5,819,629 A * 10/1998 Sarich ..... B26B 29/063 83/745
D410,366 S * 6/1999 Chiasson ..... D7/673
5,924,352 A * 7/1999 Lothe ..... B26B 29/06 220/528
5,946,998 A * 9/1999 Thompson ..... B26B 29/063 269/270
6,082,645 A * 7/2000 Himmighofen ..... B26D 3/283 241/168
6,318,222 B1 * 11/2001 Weinman, Jr. ..... B26D 3/28 144/175
7,182,234 B2 * 2/2007 Rayssac ..... B28D 5/0011 156/718
7,216,574 B2 * 5/2007 Woods ..... B26D 3/30 30/278
D598,252 S * 8/2009 West ..... D7/698
7,836,822 B2 * 11/2010 Cheng ..... A47J 25/00 83/114
8,250,959 B2 * 8/2012 Beber ..... A47J 43/0716 83/857
8,474,359 B2 * 7/2013 George ..... A47J 47/005 269/287
8,677,895 B2 * 3/2014 Beber ..... A47J 43/0711 241/101.1
8,757,607 B1 * 6/2014 Benaksas ..... B26B 29/063 269/289 R
8,870,637 B1 * 10/2014 Leuallen ..... A22C 25/06 452/195
9,073,229 B2 * 7/2015 Zaretsky ..... B26D 3/185
D758,149 S * 6/2016 Wong ..... D7/693
2004/0031158 A1 * 2/2004 Boerner ..... A47J 43/25 30/286
2004/0144487 A1 * 7/2004 Martinez ..... B28D 5/0011 156/765
2005/0206060 A1 * 9/2005 Siegel ..... A47J 47/005 269/289 R
2007/0028785 A1 * 2/2007 Foster ..... B26D 7/1818 99/537
2010/0263212 A1 * 10/2010 Settele ..... A47J 25/00 30/113.1
2012/0031250 A1 * 2/2012 Hocker ..... B26D 7/0006 83/821
2012/0131800 A1 * 5/2012 Hauser ..... B26D 1/30 30/124

* cited by examiner

DEVICES AND METHODS FOR ASSISTING WITH SLICING ITEMS

RELATED APPLICATIONS

This application claims the benefit of U.S. Provisional Patent Application No. 62/000,310 filed on May 19, 2014, which is herein incorporated by reference in its entirety.

FIELD OF THE INVENTION

This invention relates to devices and methods for assisting with slicing one or more items, such as food items. Such devices may be referred to herein as press and slice devices.

BACKGROUND

When cutting and slicing items, such as food items (e.g., fruits, vegetables, meats, cheeses, breads, etc.) or non-food items (e.g., molding clay, children's dough, etc.), it may be desirable to slice the items as quickly and/or as accurately as possible. In some cases, it may also be desired to cut numerous small items at once, to, for example, save time and effort. Items can be cut by hand without any additional implements or the items may be cut using existing implements. However, such known techniques typically produce inconsistent results (e.g., disproportionate portions) and/or they are limited to one or a few particular items (e.g., a bagel slicer intended to assist with slicing bagels, an apple slicer intended to assist with slicing apples, an egg slicer intended to assist with slicing eggs, etc.). In addition, such known methods may crush the items being sliced (or otherwise deform the items in an undesired manner) when, for example, the items are being held to assist in slicing them. This issue is particularly exacerbated when dealing with items of varying shape, size, and/or consistency. Further, such known methods may be dangerous, where, for example, they do not provide adequate protection or clearance for hands and fingers when slicing the items.

SUMMARY OF THE INVENTION

According to some aspects of the invention, a device for assisting with slicing one or more items is provided. The device includes a base having a top edge and a bottom edge, a lid having a top edge and a bottom edge, a flexible base layer removably attached to the top edge of the base, a flexible lid layer removably attached to the bottom edge of the lid, and means for positionally securing the lid relative to the base. In some embodiments, at least one of the flexible base and lid layers is textured to help reduce movement of the one or more items in the plane of the flexible layers. In some embodiments, the device further includes a handle removably attached to the top edge of the lid. In some embodiments, the handle includes an inner portion and an outer portion, the handle inner portion height differing from the handle outer portion height. In some such embodiments, the handle outer portion height is lower relative to the top edge of the lid. In some embodiments, the device further includes a foot removably attached to the bottom edge of the base. In some such embodiments, the foot material has a higher coefficient of friction than the base material. In some embodiments, at least one of the base and lid are hollow to allow the respective flexible layer to deflect into the hollow space. In some embodiments, the bottom edge of the base and the top edge of the lid have substantially similar shapes. In some embodiments, the base and lid have a substantially circular or elliptical ring shape. In some embodiments, the base and lid have a substantially square or rectangular ring shape. In some embodiments, the base and lid comprise plastic, ceramic, metal, wood, and/or glass. In some embodiments, the flexible layers comprise silicone, plastic, rubber, and/or an elastomeric material. In some embodiments, the device is made of non-toxic, food-safe material. In some embodiments, the means for positionally securing the lid relative to the base includes a post and slot system comprising a post on one of the base and lid and a slot disposed in the other of the base and lid. In some embodiments, the post and slot system creates a clearance space between a majority of the top edge of the base and the bottom edge of the lid. In some such embodiments, the clearance space is between about 0.05 and 30 mm. In some such embodiments including the post and slot system, the post provides a mechanical stop for a cutting utensil used with the device. In some embodiments, the means for positionally securing the lid relative to the base includes a hinge system configured to rotationally couple the lid relative to the base. In some such embodiments, the hinge system is attached to the outside of the base and the lid. In some embodiments, the means for positionally securing the lid relative to the base includes a ridge and groove system comprising a ridge on the outside of one of the base and lid and a groove disposed in the outside of the other of the base and lid. In some embodiments, the means for positionally securing the lid relative to the base includes a cord or loop that connects the lid to the base. In some embodiments, the flexible layers include visual and/or tactile indicators based on intended items of use. In some embodiments, the flexible layers may be removed and replaced with other flexible layers. In some embodiments, the one or more items are food items. In some embodiments, the one or more items are non-food items.

According to another aspect of the invention, a method of assisting with the slicing of one or more items is provided. The method includes inserting the one or more items between a base and a lid of a device of any aforementioned aspect or embodiment of a device of the invention. In some embodiments, the method further includes slicing the one or more items using one or more knives or blades. In some such embodiments, the knife or blade is attached to the device. In some embodiments, the method further includes slicing the one or more items using one or more wires or filaments. In some such embodiments, the one or more wires or filaments are attached to the device. In some embodiments, the one or more items are food items. In some embodiments, the one or more items are non-food items.

According to another aspect of the invention, a device for assisting with slicing one or more items is provided. The device includes a first component including a flexible layer removably attached to an edge of the first component, and a second component including a flexible layer removably attached to an edge of the second component, wherein the flexible layers are configured to help secure the one or more items between the first and second components. In some embodiments, the one or more items are centered when pressed between the flexible layers of the device. In some embodiments, the one or more items are not centered when pressed between the flexible layers of the device. In some embodiments, the flexible layers are configured to secure numerous items of diverse size, shape, and/or consistency, such that the items can each be cut substantially in half without crushing the items.

The present invention is not intended to be limited to a system or method that must satisfy one or more of any stated objects or features of the invention. It is also important to note that the present invention is not limited to the exemplary or primary embodiments described herein. Modifications and substitutions by one of ordinary skill in the art are considered to be within the scope of the present invention.

Figure 1:
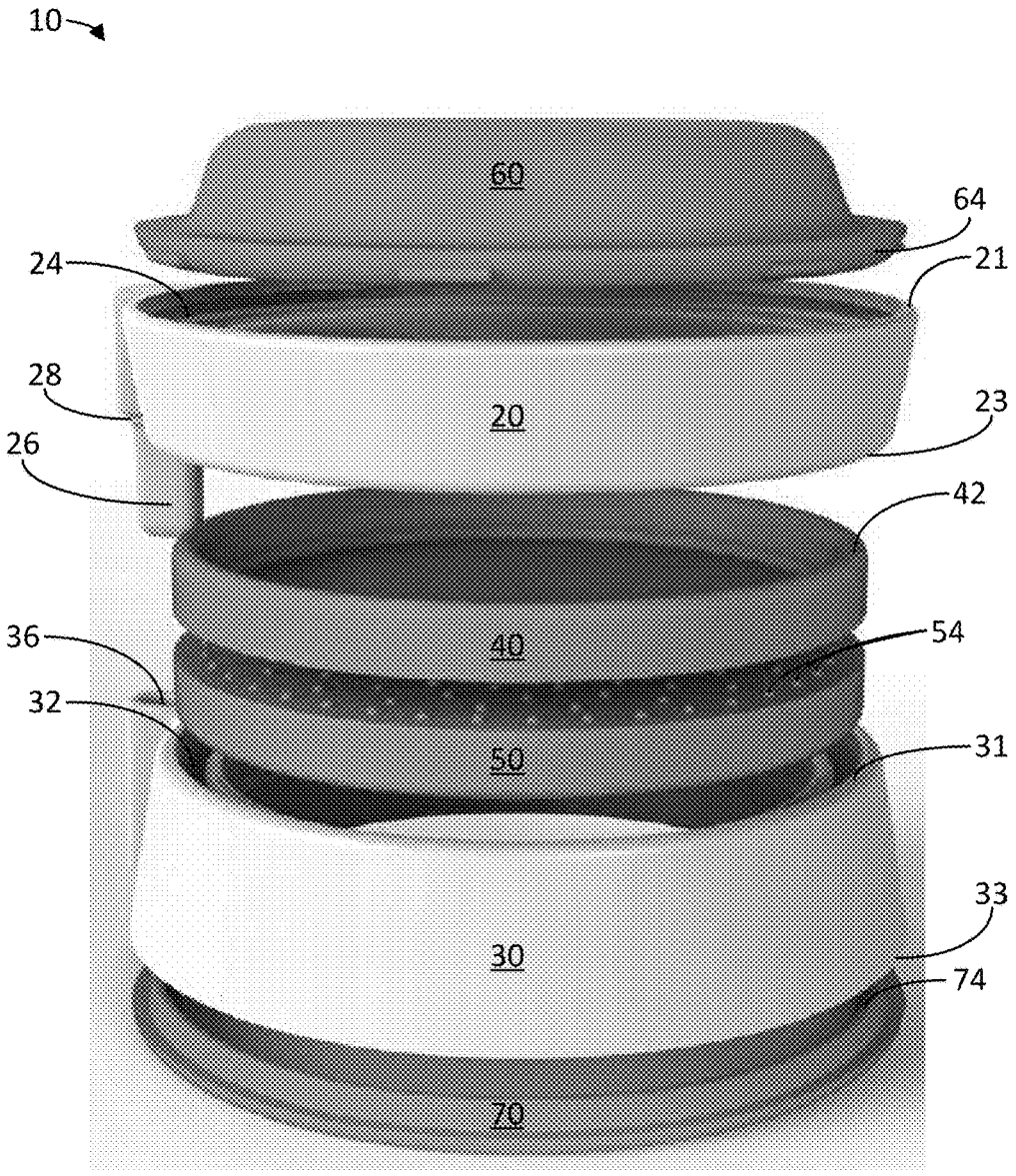
FIG. 1 illustrates an exploded side-perspective view of a press and slice device, configured in accordance with an embodiment of the present invention.

These and other features of the present embodiments will be understood better by reading the following detailed description, taken together with the figures herein described. The accompanying drawings are not intended to be drawn to scale. In the drawings, each identical or nearly identical component that is illustrated in various figures is represented by a like numeral. For purposes of clarity, not every component may be labeled in every drawing.

DETAILED DESCRIPTION

The present disclosure relates to devices and methods for assisting with slicing one or more items, such as food items. Such devices may be referred to herein as press and slice devices. A press and slice device as variously described herein may include two main components, such as a base and a lid. The base and lid may each include a flexible layer, and the flexible layers may be configured to hold the items being sliced when the lid and base are pressed together. In this manner, the press and slice device can allow a user to quickly/efficiently, accurately, and safely slice items, saving time and effort. The press and slice device also allows a user to safely slice numerous items of varying shapes, sizes, and consistencies all at once. The press and slice device also allows a user to safely slice items that are entirely different all at once, such as all of the toppings of a salad (e.g., tomatoes, cheeses, onions, cucumbers, berries, etc.). In some embodiments, the lid may include a handle to, for example, help the user hold the lid and protect the user's fingers. In some embodiments, the base may include a foot made of a material with a higher coefficient of friction than the material of the base to, for example, help secure the base to the surface the device is being used on. The press and slice device may be used to slice food items, such as various fruits, vegetables, meats, eggs, cheeses, breads, grains, sweets, and baked goods, or non-food items, such as molding clay and children's dough.

In some embodiments, the lid and base may include means for positionally securing the lid relative to the base, such as using a post and slot system (e.g., where a post is attached to one of the lid and base and a slot is disposed in the other of the lid and base). In such embodiments, the post and slot system may help a user locate and align the two components (the lid and the base). The post may also provide a stopping point for a knife (or other cutting utensil used) when slicing through items using the device, controlling the path of the knife for safety purposes, for example. In addition, the post may include a ridge or portion that is too large to enter the slot, creating a clearance space between the lid and base when fully pressed together. The clearance space may allow a user to insert a knife in between the lid and base in order to slice the items being held between the flexible layers, even when the lid and base are pressed fully together. Numerous variations and configurations will be apparent in light of this disclosure.

Figure 2:
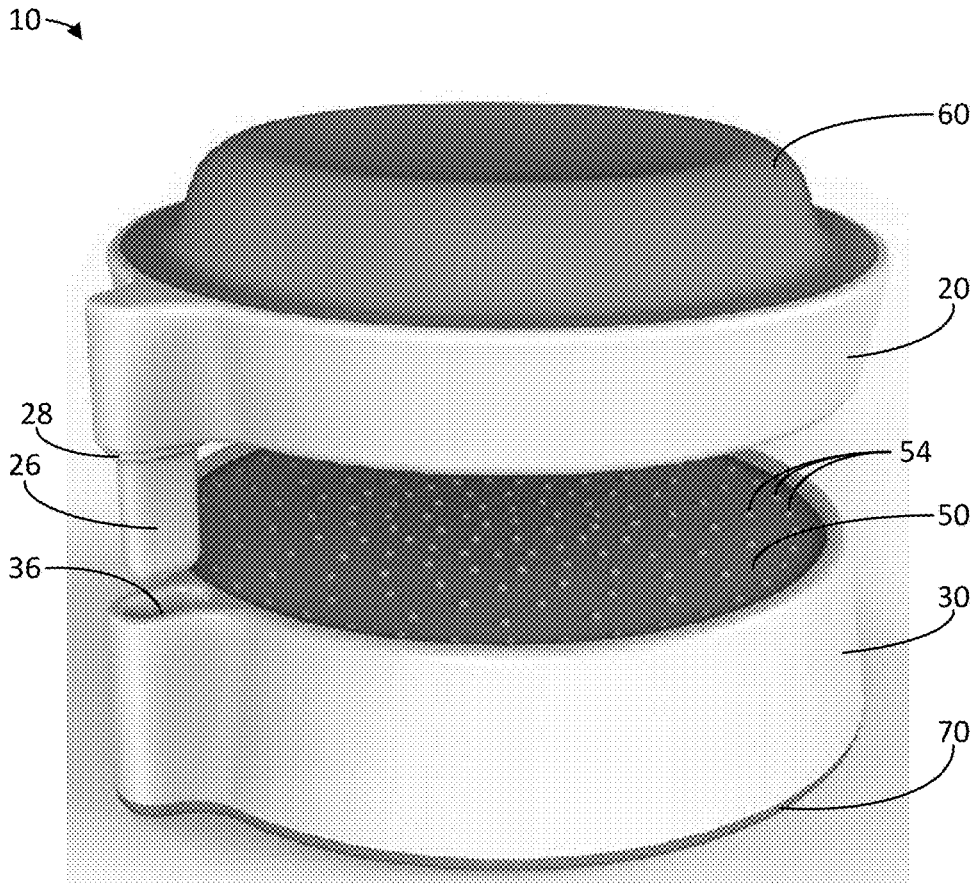
FIG. 2 illustrates an assembled side perspective view of the press and slice device of FIG. 1.
Figure 3:
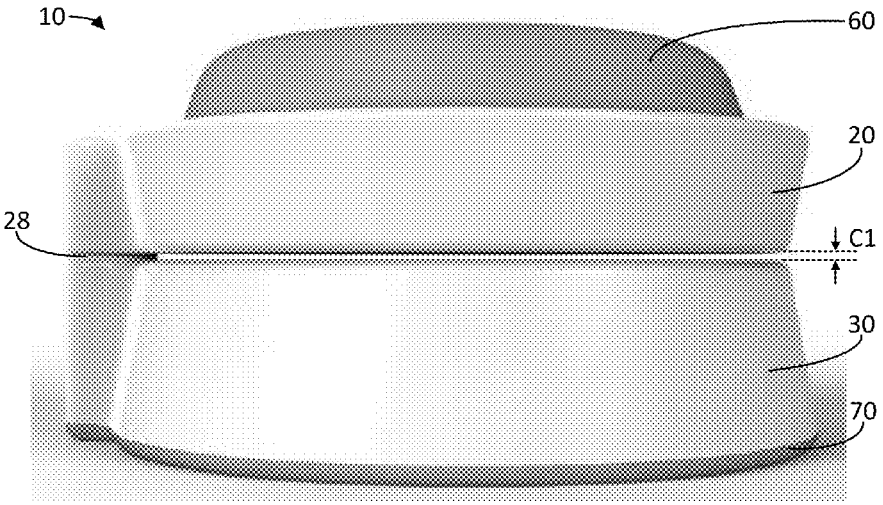
FIG. 3 illustrates an assembled side planar view of the press and slice device of FIG. 1.
Figure 4:
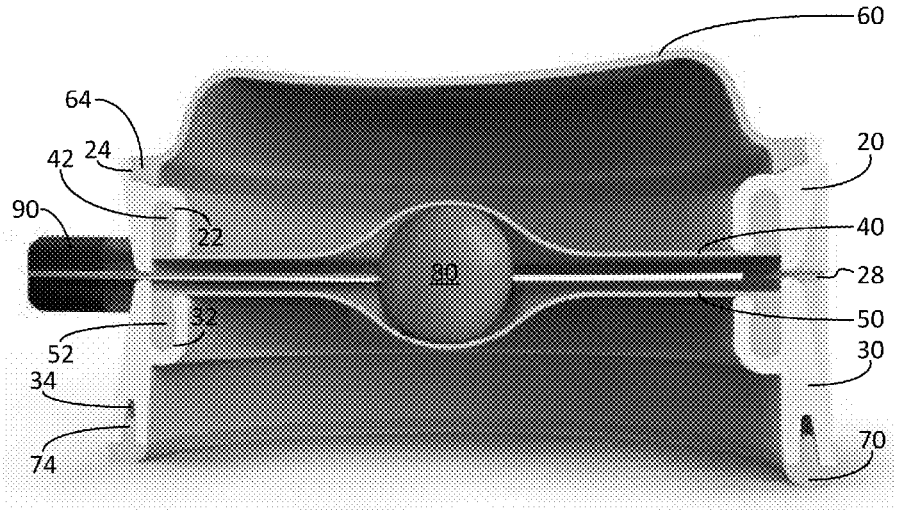
FIG. 4 illustrates an assembled side planar cross-sectional view of the press and slice device of FIG. 1, including a knife slicing through a cherry tomato being held between flexible layers of the device.

FIGS. 1-4 illustrate a press and slice device 10, configured in accordance with an embodiment of the present invention. More specifically: FIG. 1 illustrates an exploded side-perspective view of press and slice device 10; FIG. 2 illustrates an assembled side perspective view of press and slice device 10; FIG. 3 illustrates an assembled side planar view of press and slice device 10; and FIG. 4 illustrates an assembled side planar cross-sectional view of press and slice device 10, including a knife 90 slicing through a cherry tomato 80 being held between flexible layers 40, 50 of the device. As can be seen, press and slice device 10 in this example embodiment includes a first component 20 (referred to herein as a lid) and a second component 30 (referred to herein as a base). Although first and second components 20, 30 are referred to herein as a lid and base, respectively, for ease of description, press and slice device 10 as variously described herein is not intended to be limited for use in any specific orientation, as will be apparent in light of this disclosure.

Lid 20 and base 30 in this example embodiment are shown having substantially circular ring shapes, where each ring has top edges 21, 31 and bottom edges 23, 33, respectively. Edges 21, 23 provide examples of top and bottom edges of lid 20, respectively; however, device 10 need not be so limited. In addition, edges 31, 33 provide examples of top and bottom edges of base 30, respectively; however, device 10 need not be so limited. Lid 20 and base 30 may have different shapes in other embodiments, including, but not limited to, substantially elliptical, square, or rectangular ring shapes, or any other suitable shape as will be apparent in light of this disclosure. Note that bottom edge 23 of lid 20 and top edge 31 of base 30 are substantially similar in shape and size in this example embodiment; however, press and slice device 10 need not be so limited. Also note that lid 20 and base 30 are hollow in this example embodiment; however, press and slice device 10 need not be so limited. Further note that lid 20 and base 30 may be constructed in various different sizes and that the present disclosure is not intended to be limited to any particular size or shape. Lid 20 and base 30 may be constructed of various suitable materials, including, but not limited to, one or more of plastic, polymeric, ceramic, metal, metal alloy, wood, and/or glass materials, and/or any other suitable material(s) as will be apparent in light of this disclosure.

Press and slice device 10 includes flexible lid layer 40 and flexible base layer 50, as shown in the example embodiment of FIGS. 1-4. As can be seen, flexible lid layer 40 is configured to removably attach to bottom edge 23 of lid 20 and flexible base layer 50 is configured to removably attach to top edge 31 of base 30. In this example embodiment, flexible layers 40, 50 include lips 42, 52 that can be press/friction fit, respectively, into slot 22 near bottom edge 23 of lid 20 and slot 32 near top edge 31 of base 30. The cross-sectional view in FIG. 4 illustrates flexible layers 40, 50 assembled in lid 20 and base 30, respectively. As can also be seen in this example embodiment, flexible layers 40, 50 are shaped to complement bottom edge 23 of lid 20 and top edge 31 of base 30, respectively; however, flexible layers 40, 50 need not be so limited. In other embodiments, flexible layers 40, 50 may be assembled with lid 20 and base 30 in another suitable manner. In some embodiments, flexible layers 40, 50 may be integral with lid 20 and base 30, respectively (and thus not separate components).

Flexible layers 40, 50 may be constructed of various suitable materials, including, but not limited to, one or more of silicone, plastic, polymeric, rubber, and/or elastomeric materials, and/or any other suitable material(s) as will be apparent in light of this disclosure. As can be seen in FIG. 4, flexible layers 40, 50 are configured to stretch/flex/deflect to conform to the items placed between them when using press and slice device 10. Flexible layers 40, 50 may have varying thicknesses, materials, sizes, shapes, and/or other properties that affect their flexibility and/or suitability for the items being used. For example, thicker flexible layers 40, 50 may be used with thicker items, such as bagels and other bread items, and thinner flexible layers 40, 50 may be used with more delicate items, such as grapes or other small fruits. In some embodiments, flexible layers 40, 50 may be able to hold items of various shapes, sizes, consistencies, textures, etc. Holding the items between flexible layers 40, 50 may include reducing or eliminating movement of the items at least relative to the cutting plane, such the items will be effectively secured by device 10 to allow a user to cut/slice the items in half or in portions smaller than the whole. Therefore, press and slice device 10 may be used to slice non-homogenous items at once (e.g., multiple strawberries having various shapes and sizes) and/or multiple different items at once (e.g., strawberries and kiwis, lemons and limes, grapes and figs, etc.).

Flexible layers 40, 50 in this example embodiment are the same and thus interchangeable; however, that need not be the case. Flexible layers 40, 50 may include visual and/or tactile indications of items they are intended to be used with. For example, visual indications may be based on the flexible layer color, pattern, thickness, material, etc., and tactile indications may be based on the flexible layer thickness of flexible layer(s), material, texture (e.g., to aid those who are visually impaired). In this manner, flexible layers 40, 50 may be removed and replaced with other flexible layers based on the items being cut. For example, device 10 may be compatible with multiple sets of flexible layers 40, 50, such as sets intended for specific food types (e.g., fruits vs. vegetables vs. breads vs. meats, etc.), sets intended for food allergies (e.g., gluten-free, peanut-free, etc.), sets intended for keeping kosher (e.g., milk products vs. meat products), and sets intended for specific non-food items (e.g., clay vs. putty, etc.), just to name a few examples. Further, the sets of flexible layers 40, 50 may be configured based on their intended use, as described herein.

Flexible layers 40, 50 may be textured to help reduce or eliminate the movement of items between them when lid 20 and base 30 are brought together to help retain the items (e.g., as is shown in FIG. 4). For example, in this example embodiment, and as can best be seen in FIGS. 1-2, flexible base layer 50 includes small bumps or dots 54 across the surface that interacts with the items. The bumps 54 add texture to help reduce or eliminate movement of the items (e.g., help reduce movement in the major plane of base 30). Flexible lid layer 40 may include bumps similar to those shown on flexible layer 50, or it may include no texture pattern or a different texture pattern and still be effective in reducing (or eliminating) movement of the items. Any number of suitable surface textures or texture patterns may be used for flexible lid layer 40 and/or flexible base layer 50 to, for example, help reduce or eliminate movement of the items being sliced in the plane of lid 20 and/or base 30. For example, other textures may include ridges, grooves, indentations, shapes, etc. However, recall that flexible layers 40, 50 may not include any surface texture (e.g., the surfaces may be smooth), yet still be effective in reducing or eliminating movement of the items. In some embodiments, flexible layers 40, 50 may be constructed from a material, include a coating, or include texture that helps reduce items used with device 10 from sticking to flexible layers 40, 50 (e.g., using a non-stick coating, such as a rubberized coating, etc.). In such embodiments, flexible layers 40, 50 can still be effective in reducing or eliminating movement of the items being held (e.g., based on the force applied to them from the two flexible layers) even though those items may not stick to the surface of the flexible layers.

In some embodiments, press and slice device 10 may include spring-loaded hard/non-flexible surfaces in place of flexible layers 40, 50 that may be deflected when pressing lid 20 and base 30 together. The spring-loaded surfaces may include springs configured to have major axes of the springs be aligned with the major axes of lid 20 and base 30, for example. In addition, in some such example cases, the springs can be pre-loaded/compressed along the major axes of lid 20 and base 30, such that when items are placed between lid 20 and base 30 and then closed/pressed together to hold the items, the springs further compress to increase the force on the items. In this manner, the spring-loaded surfaces may perform a similar function as that of flexible layers 40, 50, as variously described herein. In such embodiments, various different springs or spring pre-load configurations may be used to adjust the deflection properties during use. In addition, various different surfaces may be used with such spring-loaded configurations, including, for example, hard plastic, metal or glass surfaces.

Press and slice device 10 may include a handle for lid 20. The example embodiment shown in FIGS. 1-4 includes handle 60 that can be removably attached to or near top edge 21 of lid 20. In this example embodiment, handle 60 includes outer edge 64 that can be press/friction fit into slot 24 near top edge 21 of lid 20 (e.g., as best shown in the cross-sectional view of FIG. 4). In other embodiments, handle 60 may attach to lid 20 in another suitable manner (e.g., using glue, hook and loop fasteners, etc.). In some such embodiments, handle 60 may not be as easily removed compared to, for example, the embodiment shown in FIGS. 1-4. Although handle 60 is a separate component in this example embodiment, in some embodiments, handle 60 may be integral with lid 20 (and thus not a separate component). Handle 60 may help protect the hand and/or fingers used to press down on lid 20 of device 10 during use (e.g., by keeping the hand and/or fingers clear of the cutting/slicing path). Handle 60 may provide a more convenient surface for grabbing and/or holding lid 20. Handle 60 may be constructed of various suitable materials, including, but not limited to, one or more of silicone, plastic, glass, wood, ceramic, metal or metal alloy, polymeric, rubber, and/or elastomeric materials, and/or any other suitable material(s) as will be apparent in light of this disclosure.

Press and slice device 10 may include a foot for base 30. The example embodiment shown in FIGS. 1-4 includes foot 70 that can be removably attached to or near bottom edge 33 of base 30. In this example embodiment, foot 70 includes lip 74 that can be press/friction fit into slot 34 near bottom edge 33 of base 30 (e.g., as best shown in the cross-sectional view of FIG. 4). In other embodiments, foot 70 may attach to base 30 in another suitable manner (e.g., using glue, hook and loop fasteners, etc.). In some such embodiments, foot 70 may not be as easily removed compared to, for example, the embodiment shown in FIGS. 1-4. Although foot 70 is a separate component in this example embodiment, in some embodiments, foot 70 may be integral with base 30 (and thus not a separate component). Foot 70 may help secure base 30 to the surface device 10 is placed on (e.g., a kitchen counter, a work surface, etc.) during use of the device. Foot 70 may be constructed of various suitable materials, including, but not limited to, one or more of silicone, plastic, polymeric, rubber, and/or elastomeric materials, and/or any other suitable material(s) as will be apparent in light of this disclosure. In some embodiments, foot 70 may be constructed of a material having a higher coefficient of friction than the material of base 30.

Press and slice device 10 may optionally include means for positionally securing lid 20 relative to base 30, in some embodiments. For example, in the embodiment shown in FIGS. 1-4, device 10 includes a post 26 and slot 36 system where post 26 can be inserted into slot 36 to at least positionally secure lid 20 and base 30 relative to each other. The post and slot system provides means for positionally securing lid 20 relative to base 30 (and/or vice versa), in this example embodiment, because when post 26 is inserted into slot 36, post 26 is substantially prevented from rotating relative to slot 36 (in the major plane of the lid and base), and thus, lid 20 is substantially prevented from rotating relative to base 30 (in the major plane of the lid and base). Therefore, the post and slot system (or other various means for positionally securing the lid relative to the base, as will be described herein) can help align lid 20 and base 30, as will be apparent in light of this disclosure. Post 26 and slot 36 may have any suitable configuration, and in some embodiments, slot 36 may be designed to accommodate or couple with post 26 (and/or vice versa), as is the case in FIGS. 1-4. Although post 26 and slot 36 are shown as integral features of lid 20 and base 30, respectively, in this example embodiment, the features need not be integral components (and thus may be separate components). For example, in some embodiments, the post and slot features may be separate components that attach to the lid and base. Further, in some embodiments, post 26 may be integral with or attached to base 30 and slot 36 may be disposed in or attached to lid 20.

Post 26 includes ridge 28 in this example embodiment. As can be seen in FIG. 3, ridge 28 is configured, in this embodiment, to provide a clearance space C1 between lid 20 and base 30, due to ridge 28 having a larger diameter or size relative to slot 36. In other words, ridge 28 does not enter slot 36, in this embodiment, when post 26 is inserted entirely into slot 36. Clearance space C1 can help a knife or other cutting utensil enter between lid 20 and base 30 (and/or flexible layers 40, 50) when slicing items between those two components. Ridge 28 (as well as post 26 and slot 36) can be configured such that clearance space C1 is at least 0.05 mm, 0.1 mm, 1 mm, 5 mm, 15 mm, 30 mm, or more than any other suitable distance as will be apparent in light of this disclosure. In some embodiments, clearance space C1 is between about 0.05 mm and 30 mm. Other suitable features may provide a similar clearance space between lid 20 and base 30 (and/or between flexible layers 40, 50), as will be apparent in light of this disclosure. In some instances, for example, the items being used with device 10 may not allow post 26 to be fully inserted into slot 36 (or it may take excessive force to do so), and in such instances, the clearance space between lid 20 and base 30 may be set by those items.

Press and slice device 10 may include various other suitable means for positionally securing lid 20 relative to base 30. Some examples of other systems or devices that may be used to positionally secure lid 20 relative to base 30 include, but are not limited to, a hinge system, a ridge and groove system, and/or a cord or loop system, just to name a few other examples. The hinge system may be configured to rotationally couple lid 20 relative to base 30 such that lid 20 is configured to close onto base 30. In some cases, the hinge system may be attached to the outside of lid 20 and base 30, for example. In some cases, the hinge system may configured with a default force that causes lid 20 to open or close relative to base 30, for example. The ridge and groove system may include a ridge on the outside or near an edge of lid 20 or base 30, and a groove disposed in the outside or near an edge of the other of base 30 and lid 20, such that the ridge and groove system help prevent lid 20 from rotating relative to base 30 (in the major plane of the lid and base). In some such embodiments including a ridge and groove system, the ridge and/or groove may be located in at least a portion of the perimeter of lid 20 and base 30 (e.g., the perimeter of bottom edge 23 of the lid and top edge 31 of the base). For example, the ridge and groove system may be located on less than half, less than a quarter, or less than some other suitable amount of the perimeter. In some embodiments, press and slice device 10 may not include means for positionally securing lid 20 relative to base 30, and in some such embodiments, the user/operator of device 10 may have to manually secure lid 20 relative to base 30 (e.g., using a non-cutting/slicing hand).

Figure 5:
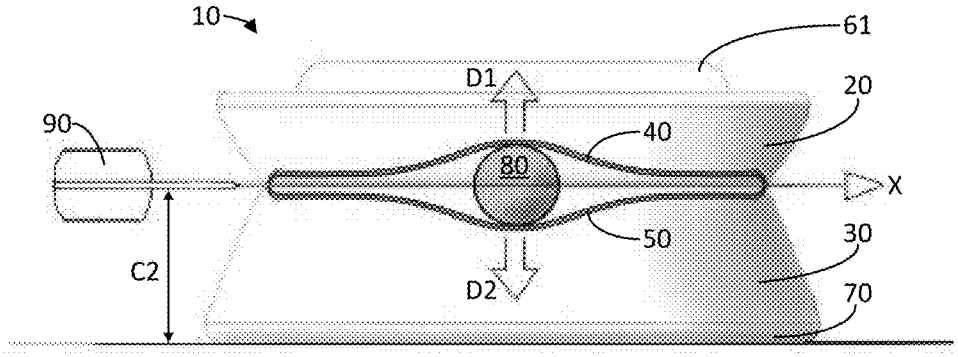
FIG. 5 illustrates a side planar view of a press and slice device showing flexible layers of the device deflecting and holding a cherry tomato, and also showing a knife path for slicing the cherry tomato, in accordance with an embodiment of the present invention.

FIG. 5 illustrates a side planar view of a press and slice device 10 showing flexible layers 40, 50 of the device deflecting and holding a cherry tomato 80, and also showing a knife 90 path for slicing cherry tomato 80, in accordance with an embodiment of the present invention. As can be seen, flexible layers 40, 50 are configured to deflect when device 10 is pressed to retain one or more items (e.g., cherry tomato 80, in this example case) to assist with slicing the items. As can also be seen, flexible lid layer 40 is deflected a distance D1 and flexible base layer 50 is deflected a distance D2. In this example embodiment, D1 is equal to D2, because flexible layers 40, 50 are the same and have the same properties. Therefore, in this example embodiment, flexible layers 40, 50 equally deform around the one or more items to be cut (e.g., cherry tomato 80, in this example case), centering them in the path of knife 90 (or any other cutting utensil used to slice the items). In other words, in such cases where flexible layers 40, 50 are the same and they are being used to hold multiple items for cutting, flexible layers 40, 50 can hold the multiple items such that the items can all be cut in half (or substantially in half) at the same time to create half portions (or substantially half portions) of the original items. The items that were just cut into half portions (or substantially half portions) can be redistributed between flexible layers 40, 50 to cut the half portions again, creating even smaller portions of the original items, and so on. In other embodiments, flexible layers 40, 50 may be configured such that D1 is generally greater than D2 or such that D1 is generally less than D2 when pressing on lid 20 to retain items to be cut (thereby generally raising or lowering the items, respectively, when holding them to be sliced). In such embodiments, the items being cut may not be cut in half, but may be cut in different proportions, such as cutting to form ⅓ and ⅔ portions, ¼ and ¾ portions, ⅕ and ⅘ portions, etc. Therefore, the flexible layers 40, 50 may be configured to secure numerous items of diverse size, shape, and/or consistency, such that the items can each be cut in half or nearly in half (or in different proportions, depending upon the properties of flexible layers 40, 50 and the items being cut) without crushing the items. It will be understood that irregularly shaped items being cut using press and slice device 10 (e.g., strawberries, pears, etc.), may not be cut in half, but into portions that are smaller than the whole.

As can also be seen in FIG. 5, base 30 and foot 70 provide clearance space C2 between the surface that press and slice device 10 is resting on and top edge 31 of base 30, in this example embodiment. In some embodiments, clearance space C2 may be at least about 2 cm, 5 cm, 10 cm, 15 cm, or more than any other suitable distance as will be apparent in light of this disclosure. In some embodiments, clearance space C2 may be between about 5 cm and 15 cm. In some embodiments, clearance space C2 may be large enough for a user to comfortably hold a knife or other cutting utensil while slicing through items held by device 10 along path X shown in FIG. 5, for example.

Figure 6:
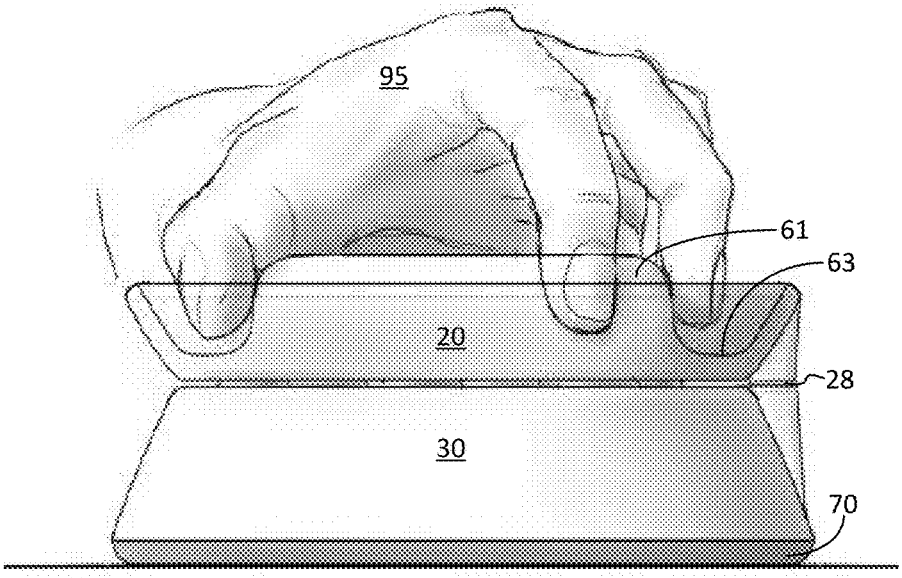
FIG. 6 illustrates a side planar view of a press and slice device showing a handle variant including a recessed section that can help protect fingers when holding the handle, in accordance with an embodiment of the present invention.

FIG. 6 illustrates a side planar view of a press and slice device 10 showing a handle variant 61 including a recessed section 63 that can help protect fingers when holding handle 61, in accordance with an embodiment of the present invention. Handle variant 63 may also help make the overall device 10 more compact. Handle variant 61 can also be seen in FIGS. 5 and 7-8.

Figure 7:
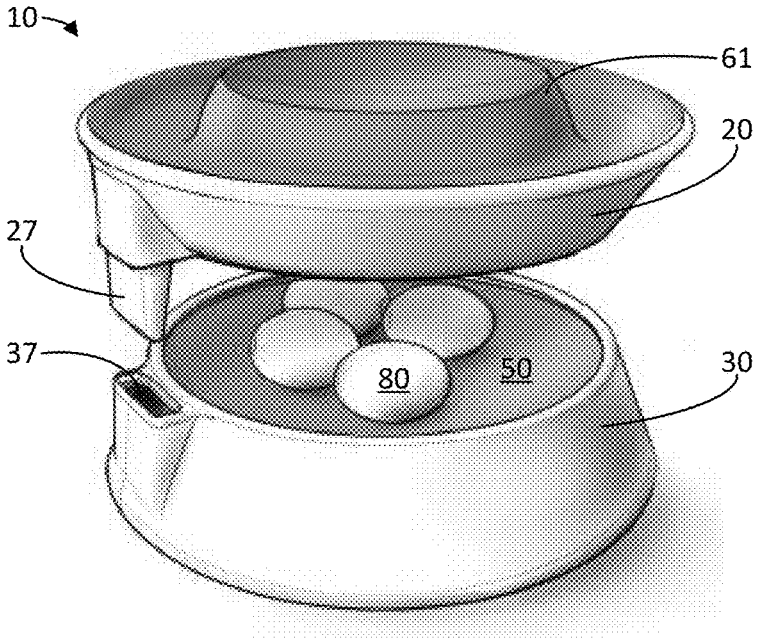
FIG. 7 illustrates a side perspective view of a press and slice device showing four cherry tomatoes resting on a flexible base layer, in accordance with an embodiment of the present invention.

FIG. 7 illustrates a side perspective view of a press and slice device 10 showing four cherry tomatoes 80 resting on a flexible base layer 50, in accordance with an embodiment of the present invention. Note that device 10 in this example embodiment includes post variant 27 and slot variant 37.

Figure 8:
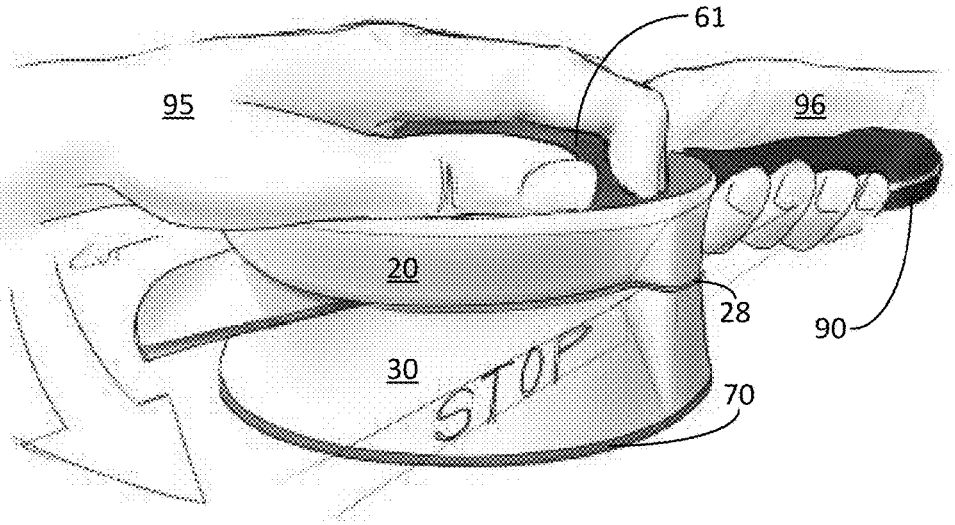
FIG. 8 illustrates a side perspective view of the press and slice device of FIG. 7, showing a user pressing on the lid of the device with one hand and slicing through the cherry tomatoes held by the device with a knife using the other hand.

FIG. 8 illustrates a side perspective view of the press and slice device 10 of FIG. 7, showing a user pressing on the lid 61 of the device 10 with one hand 95 and slicing through the cherry tomatoes 80 held by the device 10 with a knife 90 using the other hand 96. As can be seen, post 26, 27 and/or post ridge 28 may provide a stopping point (or a mechanical block) for knife 90 (or for any other cutting utensil used). In this manner, the means for positionally securing lid 20 relative to base 30 (e.g., the post and slot system, in this example case) may also act as means for providing a knife stop. Such knife stop means of device 10 can increase safety when using knife 90 (or other cutting utensil) to slice items. In some embodiments, the cutting utensil block/stop (e.g., ridge 28, in the example shown in FIG. 8) may be constructed of or include a layer of a material that will not damage various cutting utensils. For example, in some such embodiments, the cutting utensil block/stop may be constructed of rubber, silicone, or some other suitable soft material.

Figure 9:
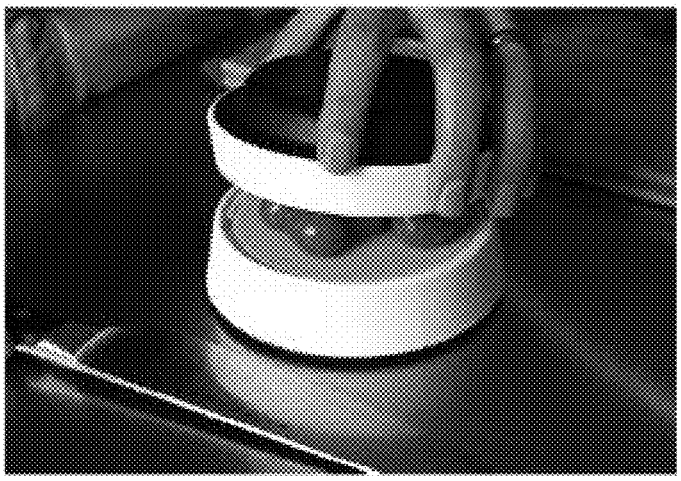
FIGS. 9-11 illustrate a method of using a press and slice device to slice through multiple cherry tomatoes, in accordance with an embodiment of the present invention.
Figure 10:
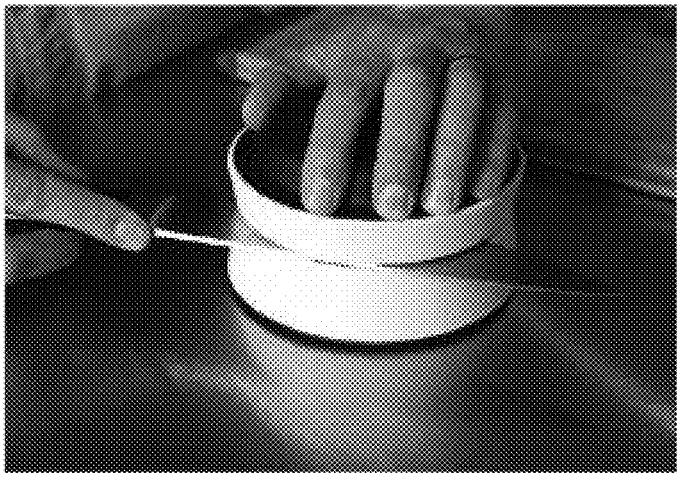
Figure 11:
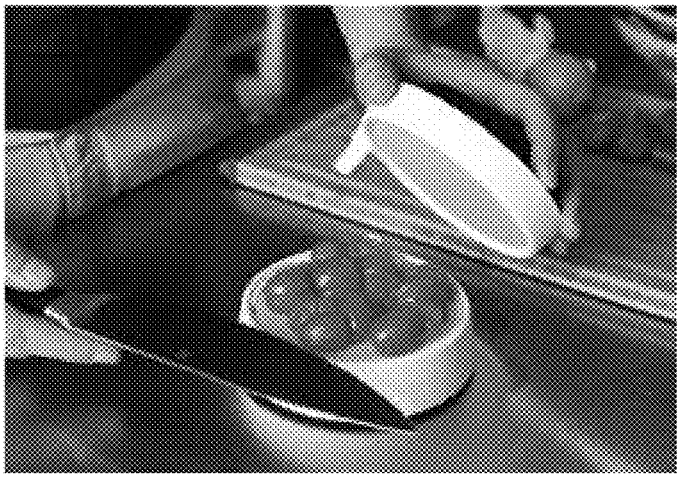

FIGS. 9-11 illustrate a method of using a press and slice device 10 to slice through multiple cherry tomatoes 80, in accordance with an embodiment of the present invention. More specifically, FIG. 9 shows base 30 resting on a kitchen countertop surface and cherry tomatoes 80 resting on flexible base layer 50 of base 30. In addition, a user is positioning lid 20 on top of cherry tomatoes 80. When positioning lid 20, slot 36 in base 30 of this example embodiment may help with locating and aligning post 26 of lid 20 to positionally secure lid 20 relative to base 30. Therefore, the post and slot system (or other means for positionally securing the lid relative to the base) may be beneficial for users who are visually impaired or have unsteady hands, for example. FIG. 10 shows the user pressing on handle 60 and/or lid 20 to secure cherry tomatoes 80 between flexible layers 40, 50, as variously described herein. As can also be seen, the user is beginning to slice through cherry tomatoes 80 using knife 90. FIG. 11 shows the user lifting lid 20 away from base 30 to expose the sliced cherry tomatoes after the user sliced through all of them. As can be seen, the cherry tomatoes 80 were efficiently and effectively cut in half, and flexible base layer 30 provides a convenient surface from which to serve or dispense the sliced cherry tomatoes (e.g., the user can then tip base 30 and/or use knife 90 to slide the sliced cherry tomatoes into a salad or into a pan, etc.). Note that while slicing through cherry tomatoes 80, foot 70 may help secure base 30 to the kitchen countertop surface (or other various work surface used) and help prevent it from slipping relative to the surface. The force of the user pressing down on handle 60 can also help secure base 30 to the kitchen countertop surface. Also note that post 26 may provide a knife stop for knife 90, as described herein. Further note that device 10 can be disassembled to aid with cleaning. For example, in some instances, only flexible layers 40, 50 may need to be cleaned between uses, such as where the items being sliced do not contact the remainder of device 10.

Although the method in FIGS. 9-11 is shown using device 10 with base 30 resting on a surface and the user slicing in a horizontal fashion relative to the surface, device 10 may be used in any desired orientation. For example, the user may use device 10 in an upright position whereby the user slices items in a vertical fashion. In such an example, the user may place a side of device 10 on the surface to assist with using device 10, after pressing the items to be sliced between flexible layers 40, 50. In some embodiments, lid 20 and/or base 30 may include one or more flat side surfaces to assist with using device 10 to cut items in a vertical fashion (in other words, when using device 10 in an upright manner). In some such embodiments, the flat surfaces may be on the same side that cutting utensil block/stop is located on (e.g., the same side as the post and slot system as variously described herein). Note that the user may have to press lid 20 and base 30 together (or squeeze them together) at all times when using device 10 in such an orientation. However, in embodiments where lid 20 and base 30 are secured to each other using a hinge system, for example, the hinge system may be configured to keep lid 20 closed relative to base 30, thereby providing enough pressure to maintain items in device 10 when in a closed position. In some embodiments, a knife, wire, filament, or other suitable cutting utensil may be used with press and slice device 10. In such embodiments, the knife, wire, or other suitable cutting utensil may be attached to device 10 to, for example, increase convenience, efficiency, and/or safety.

In some embodiments, one or more of the components of press and slice device 10 may be constructed of one or more materials capable of withstanding high temperatures, low temperatures, and/or any temperature there between. In some cases, high temperatures may include, but are not limited to, temperatures reaching 100° F., 150° F., 200° F., 250° F., or some other suitable temperature ceiling. Such construction may permit a user to utilize device 10 with hot food or non-food items that, for example, have just been cooked. In some cases, low temperatures may include, but are not limited to, temperatures down to 25° F., 0° F., −25° F., −50° F., or some other suitable temperature floor. Such construction may permit a user to utilize device 10 with cold food or non-food items that, for example, are frozen. In some embodiments, device 10 may be constructed with materials that can withstand a wide range of temperatures. One skilled in the art will be able to recognize and utilize appropriate material or materials for high-temperature and/or low-temperature applications.

In some embodiments, one or more components of press and slice device 10 may be constructed of one or more materials that may be cleaned safely within a dishwasher. Device 10 may be constructed of a material that has a non-stick surface. Device 10 may be constructed of a non-toxic, food-safe material. In an example embodiment, lid 20 and base 30 are constructed of food-safe acrylonitrile butadiene styrene (ABS), flexible layers 40, 50 are constructed of silicone, handle 60 is constructed of soft touch rubber, and foot 70 is constructed of silicone.

Press and slice device 10 may be used with foods and other edible items, as described herein. Such food items may include, but are not limited to, various fruits, vegetables, meats, eggs, cheeses, breads, grains, sweets, baked goods, etc. In some embodiments, device 10 may be used for non-food or non-edible items including, but not limited to, modeling compound, gelatinous substances, resins, clay, or any other suitable materials that may benefit from the use of device 10.

Although several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto; the invention may be practiced otherwise than as specifically described and claimed. The present invention is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications, and publications that are cited or referred to in this application are incorporated in their entirety herein by reference.

What is claimed is:

1. A device for assisting with slicing one or more items, the device comprising:

a base having a top edge and a bottom edge;

a lid having a top edge and a bottom edge;

a flexible base layer removably attached to the top edge of the base, the flexible base layer extending across the base such that it is configured to conform to the shape of the items;

a flexible lid layer removably attached to the bottom edge of the lid, the flexible lid layer extending across the lid such that it is configured to conform to the shape of the items; and means for positionally securing the lid relative to the base;

wherein at least one of the base and lid are hollow such that the at least one of the base and lid includes an unfilled space to allow the respective flexible layer to deflect into the unfilled space.

2. The device of claim 1, wherein at least one of the flexible base and lid layers is textured to help reduce movement of the one or more items.

3. The device of claim 1, further comprising a handle removably attached to the top edge of the lid.

4. The device of claim 1, further comprising a foot removably attached to the bottom edge of the base, wherein the foot includes material having a higher coefficient of friction than material of the base.

5. The device of claim 1, wherein the bottom edge of the base and the top edge of the lid have substantially similar shapes.

6. The device of claim 1, wherein the base and lid have a substantially circular, elliptical, square, or rectangular ring shape.

7. The device of claim 1, wherein the flexible layers include at least one of silicone, plastic, rubber, and an elastomeric material.

8. The device of claim 1, wherein the means for positionally securing the lid relative to the base includes a post and slot system comprising a post on one of the base and lid and a slot disposed in the other of the base and lid.

9. The device of claim 8, wherein the post and slot system creates a clearance space between a majority of the top edge of the base and the bottom edge of the lid.

10. The device of claim 8, wherein the post provides a mechanical stop for a cutting utensil used with the device.

11. The device of claim 1, wherein the means for positionally securing the lid relative to the base includes a hinge system configured to rotationally couple the lid relative to the base.

12. The device of claim 1, wherein the flexible layers may be removed and replaced with other flexible layers.

13. The device of claim 1, wherein the one or more items are food items.

14. The device of claim 1, wherein the one or more items are non-food items.

* * * * *